US008419867B2

(12) United States Patent
Agarwal et al.

(10) Patent No.: US 8,419,867 B2
(45) **Date of Patent: *Apr. 16, 2013**

(54) GOLD ALLOY COMPOSITIONS FORMED BY ENVIRONMENTALLY FRIENDLY PROCESS

(75) Inventors: Dwarika P. Agarwal, Attleboro, MA (US); Grigory Raykhtsaum, Sharon, MA (US); Richard V. Carrano, North Attleboro, MA (US)

(73) Assignee: Hallmark Sweet, Inc., Attleboro, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/228,748

(22) Filed: Aug. 15, 2008

(65) Prior Publication Data

US 2009/0191089 A1 Jul. 30, 2009

Related U.S. Application Data

(63) Continuation-in-part of application No. 11/124,935, filed on May 9, 2005, now Pat. No. 7,413,705.

(51) Int. Cl.
*C22C 5/00* (2006.01)

(52) U.S. Cl.
USPC ..... 148/430; 148/405; 420/511

(58) Field of Classification Search ..... 148/430, 148/405; 420/511
See application file for complete search history.

(56) References Cited

U.S. PATENT DOCUMENTS 5,045,411 A * 9/1991 Taylor et al. ..... 428/672
5,384,089 A * 1/1995 Diamond ..... 420/511

FOREIGN PATENT DOCUMENTS

JP 63169344 * 7/1988

OTHER PUBLICATIONS

Gold, UNS P00190 (14 karat yellow gold jewelry), Worldwide Guide to Equivalent Nonferrous Alloys, 4th ed. ASM International 2001.*
Frances H. Brown, Is 24K gold pure?, http://www.sciam.com/print version, cfr?articlesID=00009644A-59D-1C72-9EB7809EC588F2D7 (Nov. 16, 2001).*
TC, Gold: Alloys and colors an in depth explanation digging for gold, http://www.timezone.com/library/archives/archives631703251272822958 (Jan. 3, 1998).*
Gold Alloys, http://www.jewellerycatalogue.co.uk/gold/gold_alloys.php (Sep. 30, 2002).*
Helmenstine, A.M., Composition of gold alloys, http://jewelrymaking.allinfoabout.com/features/goldalloys.html (Aug. 21, 2004).*
Raykhtsaum, G. and Agarwal, D.P., The color of gold, A.J.M. (Oct. 1994).*

* cited by examiner

*Primary Examiner* — Sikyin Ip
(74) *Attorney, Agent, or Firm* — Gottlieb, Rackman & Reisman, PC

(57) ABSTRACT

Rose-color and yellow-color gold alloys are formed from a gold-base alloy containing silver and copper. Mining these elements is usually highly detrimental to the environmental. Environmentally friendly alloys are obtained through the use of recycled elements and elements recovered from mines utilizing specific guidelines. Jewelry manufactured from these environmentally friendly alloys may be more receptive to a consumer, resulting in a competitive advantage.

8 Claims, 2 Drawing Sheets

GOLD ALLOY COMPOSITIONS FORMED BY ENVIRONMENTALLY FRIENDLY PROCESS

CROSS-REFERENCE TO RELATED APPLICATIONS

This patent application is a continuation-in-part of U.S. patent application Ser. No. 11/124,935, titled Rose-Colored Gold Alloy Compositions with Reversible Hardness Characteristics, that was filed on May 9, 2005, now U.S. Pat. No. 7,413,705. The subject matter of that patent application is incorporated by reference in its entirety herein.

TECHNICAL FIELD

The present invention relates generally to gold alloy compositions, and, more particularly, to improved 14-karat and 18-karat rose-colored and gold-colored gold alloy compositions having reversible hardness characteristics between their respective annealed- and age-hardened values. The alloys are formed by environmentally cleaner methods than typical for gold alloys, and may be referred to as "green" alloys.

BACKGROUND ART

Traditionally, 14- and 18-karat gold alloy compositions have been used in the manufacture of various items of jewelry, such as bracelets, necklaces, rings, and the like.

Some gold alloys have been developed that offer the capability of reversibility, by selective application of an appropriate heat treatment, between their annealed-hardness and aged-hardness values. In many cases, there is a considerable difference between these hardness values. Hence, an alloy may be annealed to lower its hardness value. This allows the alloy to be worked more easily. After the alloy has been worked, and the article thereof formed or repaired, the article may be aged-hardened to a higher hardness value to increase its resistance to denting and deformation. However, if there is a subsequent need to rework or repair the item, it may be annealed to reduce its hardness back down to its annealed-hardness value. After the item has been reworked or repaired, it may be aged-hardened to increase its hardness to a higher hardness value. Thus, by selectively heating and cooling these alloy compositions, the hardness of these compositions may be selectively varied. It is known to produce yellow (e.g., U.S. Pats. No. 5,180,551 and 6,676,776), white (e.g., U.S. Pat. No. 5,919,320) and green (e.g., U.S. Pat. No. 6,406,568) alloy compositions having such reversible hardness characteristics.

Grain structure is another characteristic that materially affects the value of an alloy. It has been known to add iridium, cobalt and/or nickel to produce an alloy having a fine grain structure. However, the use of these additives have to be closely controlled for fear of separation of these elements or formation of "hard spots" in the alloy. Nickel is a known cause of an allergic reaction with the skin that results in dermatitis. The use of these various grain refiners is discussed in Ott, "Optimizing Gold Alloys for the Manufacturing Process", Gold Technology, Issue No. 34 (Spring 2002) [at pp. 37-44].

Other gold alloy compositions are shown and described in U.S. Pat. Nos. 5,173,132 and 5,749,979. The aforesaid articles and each of the aforesaid patents are hereby incorporated by reference.

It would be generally desirable to provide rose-colored gold alloy compositions having hardnesses that are capable of being selectively varied between their respective annealed-hardness and age-hardness values.

DISCLOSURE OF THE INVENTION

The present invention broadly provides 14-karat and 18-karat rose-colored gold alloy compositions having hardnesses that may be selectively, controllably and reversibly varied between their respective annealed-hardness and age-hardened values.

The color of gold alloy compositions is no longer a matter of subjective impression. Rather, color is now determined objectively in terms of its component colors, a* (red-green) and b* (blue-yellow) and L* (brightness) on a CieLab color-measuring system. This method of measuring color is described in G. Raykhtsaum et al., "The Color of Gold", A. J. M. (October 1994). While color is now measured objectively, the consumer appeal of a particular color or tint is still subjective.

In one aspect, the invention provides various 14-karat rose-colored gold alloy compositions that include: about 58.5% gold; about 9.0-12.0% silver; about 0.0-0.2% zinc; about 0.3-0.4% cobalt; about 0.0-0.02% iridium; about 29.0-33.0% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 600° F. for about one and one-half hours and thereafter allowing such composition to cool in a non-oxidizing atmosphere); and wherein the color of such compositions is between about 5-7 CieLab a* color units and between about 17-21 CieLab b* color units.

In the preferred compositions, the annealed-hardness value is between about 160-185 VHN, and the age-hardness value is at least about 220 VHN.

In another aspect, the invention provides an 18-karat rose-colored gold alloy compositions that include: about 75.2% gold; about 7.0% silver; about 0.0-0.2% zinc; about 0.3-0.4% cobalt; about 0.0-0.02% iridium; about 17.0-17.5% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 550° F. for about one and one-half hours and thereafter allowing such composition to cool in a non-oxidizing atmosphere); and wherein the color of such compositions is between about 5-7 CieLab a* color units and between about 17-21 CieLab b* color units.

Here again, in the preferred compositions, the annealed-hardness value is between about 160-185 VHN, and the age-hardness value is at least about 220 VHN.

Accordingly, the general object of the invention is to provide improved rose-colored gold alloy compositions.

Another object is to provide improved rose-colored gold alloy compositions having hardnesses that may be selectively, controllably and reversibly varied between their respective annealed-hardness and age-hardened values.

These and other objects and advantages will become apparent from the foregoing and ongoing written specification, the drawings, and the appended claims.

DESCRIPTION OF THE PREFERRED EMBODIMENTS

Figure 1:
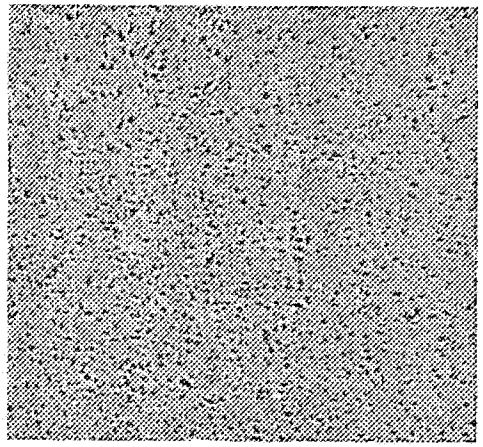
FIG. 1 is a photomicrograph, taken at a magnification of 75times, showing Alloy No. 6 after having been annealed to about 1000° F., this view showing the average grain size as being about 5 microns.

The present invention broadly provides improved 14-karat and 18-karat rose-colored gold alloy compositions having hardnesses that are selectively, controllably and reversibly variable between their respective annealed-hardness values and age-hardness values.

Table A is a table showing the composition, color and hardness characteristics of two prior art 14-karat gold alloy compositions.

TABLE A

| Alloy | Composition | | | | | Color | | | Hardness (VHN) | | Melting Range | |
|---|---|---|---|---|---|---|---|---|---|---|---|---|
| | | | | | | | | | | Age | Solius | Liquidus |
| No. | % Au | % Ag | % Cu | % Zn | % Co | a* | b* | L* | Annealed | Hardened | ° C. | ° C. |
| 1 | 58.5 | 0 | 40.7 | 0.8 | 0 | 8.8 | 14 | 86 | 140 | 145 | 940 | 965 |
| 2 | 58.5 | 12.1 | 0 | 2.74 | 0.4 | 2.9 | 20 | 84 | 170 | 250 | 830 | 870 |

Two prior art gold alloy compositions are shown in Table A. In Table A, the column headings are for Alloy No.; alloy composition in terms of percentage of gold (% Au), silver (% Ag), copper (% Cu), zinc (% Zn) and cobalt (% Co); color in terms of CieLab a*, b* and L* units; hardness, both annealed an age-hardened, in terms of Vickers Hardness Number (VHN); and melting range in terms of the Solidus and Liquidus temperatures, both expressed in ° C.

Alloy No. 1 has been commercially available for some time. It contains mainly gold and copper, and has a reddish-copper color. However, it is not heat treatable, and does not have reversible hardness characteristics.

Alloy No. 2 is similar to the alloys that are disclosed in U.S. Pat. No. 5,180,551. It has reversible hardening characteristics, but its red color component is only 2.9, and the resulting alloy is predominately yellow in color.

Table B is a table showing the composition, color and hardness characteristics of eight 14-karat gold alloy compositions, some of which have been found to be acceptable.

TABLE B

| Alloy | Composition | | | | | | Color | | | Hardness (VHN) | | Melting Range | |
|---|---|---|---|---|---|---|---|---|---|---|---|---|---|
| | | | | | | | | | | | Age | Solius | Liquidus |
| No. | % Au | % Ag | % Cu | % Zn | % Co | % In | a* | b* | L* | Annealed | Hardened | ° C. | ° C. |
| 3 | 58.5 | 8 | 32.0 | 0.2 | 0.4 | 0 | 6.9 | 17.4 | 86.5 | 164 | 186 | 865 | 904 |
| 4 | 58.5 | 9 | 31.9 | 0.2 | 0.4 | 0 | 6.4 | 17.6 | 86.2 | 175 | 221 | 861 | 899 |
| 5 | 58.5 | 10 | 30.9 | 0.2 | 0.4 | 0 | 6.5 | 18.8 | 86.6 | 171 | 230 | 855 | 890 |
| 6 | 58.5 | 10 | 30.895 | 0.2 | 0.4 | 0.005 | 6.5 | 18.8 | 86.6 | 174 | 250 | 855 | 890 |
| 7 | 58.5 | 11 | 30 | 0.2 | 0.3 | 0 | 6.1 | 18.4 | 86.8 | 170 | 250 | 851 | 887 |
| 8 | 58.5 | 12 | 29.1 | 0.2 | 0.4 | 0 | 5.2 | 18.8 | 86.7 | 182 | 262 | 848 | 889 |
| 9 | 58.5 | 12 | 28.9 | 0.2 | 0.4 | 0 | 5.4 | 19.1 | 87.2 | 181 | 275 | 848 | 880 |
| 10 | 58.5 | 15 | 25.9 | 0.2 | 0.4 | 0 | 4.3 | 20.1 | 88.4 | 160 | 250 | 838 | 866 |

Eight additional 14-karat gold alloy compositions are listed in Table B, which is provided in the drawings. In Table B, the column headings are for Alloy No.; alloy composition in terms of percentage of gold (% Au), silver (% Ag), copper (% Cu), zinc (% Zn), cobalt (% Co) and iridium (% In); color in terms of CieLab a*, b* and L* units; hardness, both annealed an age-hardened, in terms of Vickers Hardness Number (VHN); and melting range in terms of the Solidus and Liquidus temperatures, both expressed in ° C.

Alloy No. 3 has an acceptable color, but the hardening behavior of this alloy was found to be unacceptable. Alloys No. 4-9 have acceptable color and the reversibility of their hardnesses is also acceptable.

Alloy No. 10 has acceptable hardness characteristics, but does not have the desirable color characteristics.

All of the improved alloys contain from about 0.3 to about 0.4% cobalt. The addition of cobalt improves the hardening characteristics, and provides the alloy composition with a fine grain structure. The grain structure may be further refined by the addition of about 0.005% iridium. Grain size of an item is also dependent on the final annealing temperature. In general, lower annealing temperatures result in finer grain structures.

FIGS. 1-4 shows the results of annealing temperature on grain size dependents for Alloy No. 6, which contains 0.005% iridium. In all three photomicrographs, the composition is the same. The only difference is the temperature at which the composition has been annealed. Thus, as shown in FIG. 1, if the alloy is annealed at about 1000° F., the average grain size will be approximately 5 microns.

Figure 2:
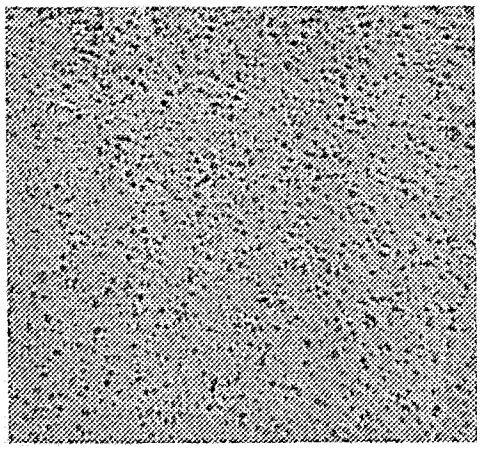
FIG. 2 is a photomicrograph, taken at a magnification of 75times, showing Alloy No. 6 after having been annealed to about 1100° F., this view showing the average grain size as being approximately 10 microns.

However, as shown in FIG. 2, if the same alloy is annealed at 1100° F., the average grain size is increased to approximately 10 microns.

Figure 3:
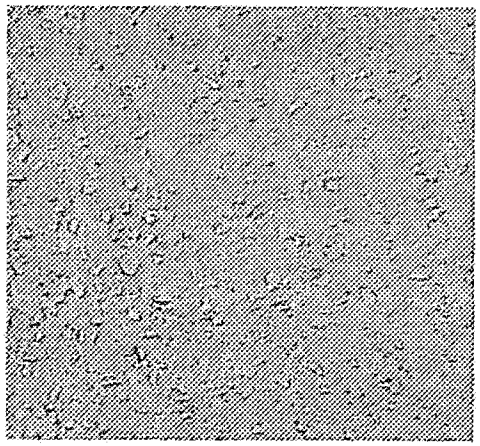
FIG. 3 is a photomicrograph, again taken at a magnification of 75times, showing Alloy No. 6 after having been annealed to 1200° F., this view illustrating the average grain size as being about 20 microns.

FIG. 3 shows the same alloy composition having been annealed to 1200° F., with the average grain size being about 20 microns.

Figure 4:
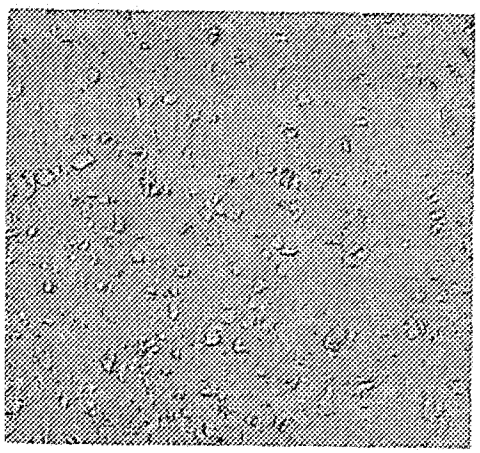
FIG. 4 is a photomicrograph, again taken at a magnification of 75times, showing Alloy No. 6 after having been annealed to 1250° F., this view showing the average grain size as being approximately 25 microns.

FIG. 4 shows the same alloy composition annealed at 1250° F., with the average grain size being about 25 microns. Thus, FIGS. 1-4 illustrate grain size increases in direct correlation to the annealing temperature.

Figure 5:
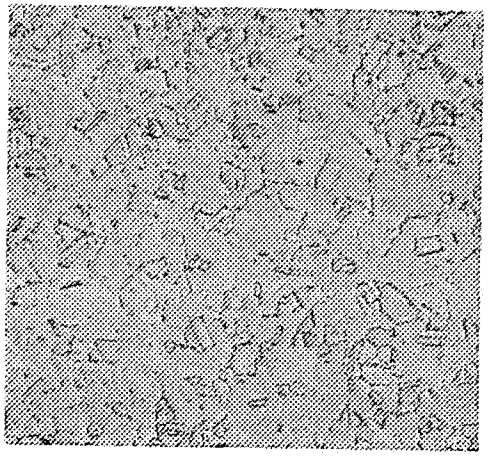
FIG. 5 is a photomicrograph, again taken at 75times, showing Alloy No. 5, after having been annealed at 1250° F., this view showing the average grain size as being approximately 45 microns.

FIG. 5 shows the effect of the addition of 0.005% iridium. It should be noted that Alloys 5 and 6 are substantially the same, but for the addition of 0.005% iridium to Alloy No. 6. FIG. 4 shows that when Alloy No. 6 was annealed at 1250° F., the average grain size was approximately 25 microns. FIG. 5, in contrast, shows that Alloy No. 5 (which has substantially the same composition as Alloy No. 6 except for the presence of iridium), when annealed at 1250° F., produced a grain structure of about 45 microns, almost twice the grain size shown to exist when Alloy No. 6 was annealed at the same temperature. Thus, it appears that the addition of a small amount of iridium reduces the average grain size substantially.

Table C is a table showing the composition, color and hardness characteristics of two improved 18-karat gold alloy compositions.

TABLE C

| Alloy | Composition | | | | | | Color | | | Hardness (VHN) | | Melting Range | |
|---|---|---|---|---|---|---|---|---|---|---|---|---|---|
| | | | | | | | | | | | Age | Solius | Liquidus |
| No. | % Au | % Ag | % Cu | % Zn | % Co | % In | a* | b* | L* | Annealed | Hardened | ° C. | ° C. |
| 11 | 75.2 | 7 | 17.5 | 0 | 0.3 | 0 | 6.1 | 20.5 | 87 | 175 | 250 | 888 | 909 |
| 12 | 75.2 | 7 | 17.195 | 0.2 | 0.4 | 0.005 | 6.0 | 20.3 | 87 | 178 | 255 | 885 | 905 |

Two improved 18-karat gold alloy compositions are listed in Table C. In Table C, the column headings are for Alloy No.; alloy composition in terms of percentage of gold (% Au), silver (% Ag), copper (% Cu), zinc (% Zn), cobalt (% Co) and iridium (% In); color in terms of CieLab a*, b* and L* units; hardness, both annealed an age-hardened, in terms of Vickers Hardness Number (VHN); and melting range in terms of the Solidus and Liquidus temperatures, both expressed in ° C.

Figure 6:
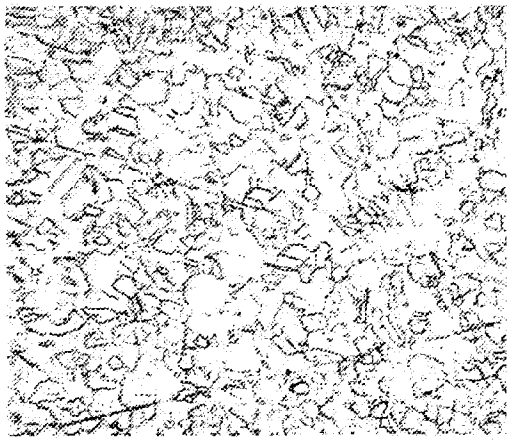
FIG. 6 is a photomicrograph, taken at a magnification of 75times, showing Alloy No. 11, after having been annealed at 1250° F., this view showing the average grain size as being about 45 microns.

FIG. 6 is a photomicrograph, taken at a magnification of 75times., showing Alloy No. 11, after having been annealed at 1250° F., this view showing the average grain size as being about 45 microns.

Figure 7:
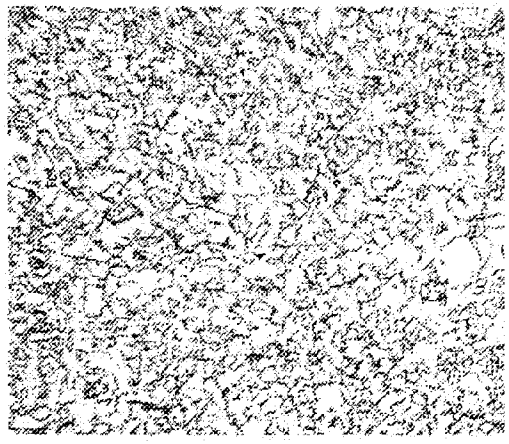
FIG. 7 is a photomicrograph, taken at a magnification of 75, showing Alloy No. 12, after having been annealed at 1250° F., this view showing the average grain size as being about 25 microns.

FIG. 7 is a photomicrograph, taken at a magnification of 75times, showing Alloy No. 12, after having been annealed at 1250° F., this view showing the average grain size as being about 25 microns. This micrograph shows the effect of iridium on reducing the average grain size.

Therefore, the present invention provides various rose-colored gold alloy compositions having hardnesses that may be selectively, controllably and reversibly varied between their respective annealed-hardness values and their respective age-hardness values.

The improved 14-karat rose-colored gold alloy compositions include: about 58.5% gold; about 9.0-12.0% silver; about 0.0-0.2% zinc; about 0.3-0.4% cobalt; about 0.0-0.02% iridium; about 29.0-33.0% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 600° F. for about one and one-half hours, and thereafter being allowed to cool in a non-oxidizing atmosphere); and wherein the color of such compositions is between about 5-7 CieLab a* color units in between about 17-21 CieLab b* color units. The annealed-hardness value may be between 160-185 VHN and the age-hardness value may be at least about 220 VHN.

The improved 18-karat rose-colored gold alloy compositions include: about 75.2% gold; about 7.0% silver; about 0.0-0.2% zinc; about 0.3-0.4% cobalt; about 0.0-0.02% iridium; about 17.0-17.5% copper; wherein the hardness of such compositions is capable of being selectively changed between its annealed-hardness value (i.e., obtained by heating the composition to about 1150° F. for about thirty minutes followed by a water quench) and its age-hardness value (i.e., obtained by heating the composition to about 550° F. for about one and one-half hours, and thereafter being allowed to cool in a non-oxidizing atmosphere); and wherein the color of such compositions is between about 5-7 CieLab a* color units and between about 17-21 CieLab b* color units.

Here again, the annealed-hardness values are between about 160-185 VHN, and the age-hardness values of this composition are at least about 220 VHN.

Among the gold-colored gold alloy compositions disclosed in U.S. Pat. No. 6,676,767 is an alloy that includes: about 58.65 weight percent gold; about 11.5-25.0 weight percent silver; about 11.85-23.35 weight percent copper; and about 2.0-7.0 weight percent zinc; wherein the color of the composition has a value of between about −3.0 to about 0.5 CieLab a* color units, and a value of between about +20.0 to about +22.0 CieLab b* color units; wherein the ratio of the amount of copper to the amount of silver is between about 0.4-2.0; and wherein the ratio of the amount of copper to the amount of silver plus twice the amount of zinc is less than about 1.0. This composition may further include a grain refiner selected from the group consisting of iridium, cobalt, platinum and iron. The grain refiner may include about 0.2-0.5 weight percent cobalt, 0.1-0.3 weight percent platinum and/or about 0.1-0.3 weight percent iron. In one particularly preferred form, the improved alloy composition has a grain refiner that includes about 0.2 weight percent cobalt, about 0.1 weight percent platinum and about 0.1 weight percent iron. The color of this particular alloy has a value of about −1.1 CieLab a* units and has a value of about +22.0 CieLab b* units, a ratio of the amount of copper to the amount of silver of about 0.6, and a ratio of the amount of copper to the amount of silver plus twice the amount of zinc of about 0.48.

Table D summarizes nominal compositions of 14 karat gold alloys described herein above. Both rose-colored and yellow-colored gold alloys have significant amounts of gold, silver and copper. Recovery of gold and silver by mining is a notoriously environmentally unfriendly process. According to one estimate, 76 tons of waste are generated for every ounce of gold recovered from open-pint mines. Large volumes of cyanide are frequently utilized to leach gold and silver from the mined ore. In addition, mining may expose sulfide rocks to the atmosphere that produce sulfuric acid when exposed to water and oxygen.

TABLE 1

| | Gold Alloy | |
|---|---|---|
| Composition | 14 Karat Rose-Color (Weight Percent) | 14 Karat Yellow Color (Weight Percent) |
| Gold | About 58.5% | About 58.65% |
| Silver | 9%-12% | 11.5%-25.0% |
| Copper | 29%-33% | 11.85%-23.35% |

An environmentally cleaner process is to utilize recycled elements, and/or elements sourced from mines that fully meet acceptable environmental standards for the elements used in the production of these gold alloy compositions. In excess of 90%, by weight, and preferably in excess of 99%, by weight, of the elements constituting the gold alloys are from recycle or environmentally responsible mining sources.

The elements are sourced from known recyclers, and/or from those sources that obtain and produce these elements using certified environmentally accepted practices such as those specified in the "Golden Rules" (promulgated by Earthworks, Oxfam America), and also those practices sanctioned by IRMA (Initiatives for Responsible Mining Assurance), and practicing FPIC (Free, Prior, and Informed Consent of land use), and the CRJP (Council for Responsible Jewelry Practices.) These practices demonstrate both environmental and social leadership in mining and include covering cost of closing down mines; ensure that projects do not contaminate the soil, water, or air; ensuring projects are not located in protected areas, fragile ecosystems, or other areas of high ecological value; refraining from dumping mine waste into oceans, rivers, and streams; ensuring projects don't force indigenous communities off their lands; ensuring projects are not located in areas of armed or militarized conflict; respecting workers rights and labor standards including Free, Prior, and Informed Consent (FPIC) of affected communities; and respecting the basic human rights as outlined in International conventions & laws.

Also of importance is the use of processes that use less energy and produce fewer by-products. In addition processing should be in accordance with the ISO 14000 environmental standard that provides: (1) Identity and Control of the environmental impact of ones activities, products and/or services; (2) Improve its environmental performance continually; and (3) Implement a systematic approach to setting environmental objectives and targets, to achieving these and to demonstrate that they have been achieved.

The environmentally friendly alloys described herein have particular utility in the jewelry industry where an ability to promote social awareness may constitute a marketing advantage.

Modifications

The present invention contemplates that many changes and modifications may be made. For example, the various components may be modified within the ranges generally set forth in the appended claims. Minor addition elements contemplates those additions to the alloys specified herein in amounts of less than 0.5%, by weight, and include zinc, cobalt and iridium. Also, the annealing and age-hardening temperatures and times may be varied within the parameters of normal experimentation, as will occur to a person skilled in this art.

All actual values indicated in Tables A-C closely approximate the indicated numerical value.

Therefore, while various improved compositions have been shown and described, and several modifications thereof discussed, persons skilled in this art will readily appreciate that various additional changes and modifications may be made without departing from the spirit of the invention, as defined and differentiated by the following claims.

We claim:

1. A gold-base alloy having a rose color and consisting of, by weight:

from 9% to 12% silver;

from 29% to 33% copper;

from 0.3% to 0.4% cobalt;

less than 0.5% each of the minor additions of zinc and iridium; and the balance gold and incidental impurities wherein at least 90% of said gold, silver and copper are obtained from a recycler, a mine, or a combination thereof using environmentally accepted practices as sanctioned by Initiatives for Responsible Mining Assurance and the Council for Responsible Jewelry Practices, said gold-base alloy having reversible hardness effective for rework and repair of an item of jewelry.

2. The gold-base alloy of claim 1 wherein in excess of 99% of said gold, silver and copper are sourced by an alloy producer from said recycler, said mine and a combination thereof.

3. The gold-base alloy of claim 1 having about 58.5% gold, 9%-12% silver, 29%-33% copper, 0.0-0.2% zinc, 0.3-0.4% cobalt and 0.0-0.02% iridium.

4. The gold-base alloy of claim 3 having between 5 and 7 CieLab a* color units and between 17 and 21 CieLab b* color units.

5. The gold-base alloy of claim 1, wherein the hardness of said alloy is capable of being selectively changed between its annealed-hardness value, obtained by heating the composition to about 1150° F. for about thirty minutes followed by a water quench, and its age-hardness value, obtained by heating said composition to about 600° F. for about one and one-half hours and thereafter being allowed to cool in a non-oxidizing atmosphere; and wherein the color of said composition is between about 5-7 CieLab a* color units and between about 17-21 CieLab b* color units.

6. The gold-base alloy of claim 1, wherein said annealed-hardness value is between about 160-185 VHN.

7. The gold-base alloy of claim 1, wherein said age-hardness value is at least about 220 VHN.

8. The gold-base alloy of claim 1, wherein said practices are in accordance with the ISO 14000 environmental standard.

* * * * *